US005304904A

United States Patent [19]

Sakai

[11] Patent Number: 5,304,904

[45] Date of Patent: Apr. 19, 1994

[54] START-UP CONTROL APPARATUS FOR ICE MAKING MACHINE

[75] Inventor: Tadashi Sakai, Toyoake, Japan

[73] Assignee: Hoshizaki Denki Kabushiki Kaisha, Toyoake, Japan

[21] Appl. No.: 930,627

[22] Filed: Aug. 17, 1992

[30] Foreign Application Priority Data

Aug. 15, 1991 [JP] Japan ..... 3-229386

[51] Int. Cl.[5] ..... H02P 7/00

[52] U.S. Cl. ..... 318/484; 62/353

[58] Field of Search ..... 318/280–286, 318/452, 482, 484; 62/353, 233, 138, 347, 126, 129; 361/24, 28, 29

[56] References Cited

U.S. PATENT DOCUMENTS

| | | | |
|---|---|---|---|
| 3,430,452 | 4/1969 | Dedricks et al. | 62/353 |
| 4,341,087 | 7/1982 | Van Steenburgh, Jr. | 62/233 |
| 4,402,194 | 9/1983 | Kuwako et al. | 62/353 |
| 4,480,441 | 11/1984 | Schulze-Berge et al. | 62/138 |
| 4,938,030 | 7/1990 | Josten et al. | 62/138 X |
| 5,056,325 | 10/1991 | Josten et al. | 62/126 |
| 5,182,925 | 2/1993 | Alvarez et al. | 62/347 |

FOREIGN PATENT DOCUMENTS 63-140272 6/1988 Japan .

*Primary Examiner*—Jonathan Wysocki
*Attorney, Agent, or Firm*—Nikaido, Marmelstein, Murray & Oram

[57] ABSTRACT

An electric control apparatus for an ice making machine mounted on an ice storage bin to store therein ice cubes formed at its ice making cycle of operation and released at its defrost cycle of operation, the ice storage bin having an ice detection switch of the normaly open type arranged to issue an electric signal therefrom when closed by engagement with the ice cubes fully stored in the ice storage bin. The electric control apparatus is designed to maintain the ice making machine inoperative when applied with the electric signal from the ice detection switch immediately after connected to an electric power source and to activate the ice making machine after lapse of a predetermined time when the ice detection switch is opened in a condition where the ice making machine is maintained inoperative.

2 Claims, 8 Drawing Sheets

START-UP CONTROL APPARATUS FOR ICE MAKING MACHINE

BACKGROUND OF THE INVENTION

1. Field of the Invention

The present invention relates to an electric control apparatus for an ice making machine in which ice making and defrost cycle of operations are automatically repeated to store an amount of ice cubes in an ice storage bin.

2. Description of the Prior Art

Disclosed in Japanese Patent Laid-open Publication No. 63-140272 is an electric control apparatus for an ice making machine mounted on an ice storage bin to store therein ice cubes formed at its ice making cycle and released at its defrost cycle, wherein an ice detection switch of the normally open type is mounted within the ice storage bin to issue an electric signal therefrom when closed by engagement with the ice cubes fully stored in the storage bin, and wherein the electric control apparatus is designed to deactivate the ice making machine after one cycle of ice making and defrost operations when applied with the electric signal from the ice detection switch.

In the case that the ice making machine is transported to a user, the ice detection switch is pressed toward a side wall of the storage bin and retained in place by an adhesive tape attached thereto so that it is retained in its closed position to be protected from shocks during transport of the ice making machine. When the ice making machine is installed with the ice storage bin at the user's side, the attachment adhesive tape is usually removed by a serviceman so that the ice detection switch is returned to its open position for effecting normal operation of the ice making machine. If in such installment the ice making machine is connected to an electric power source in a condition where the ice detection switch is retained in its closed position without removing the attachment adhesive tape, the ice making machine is activated for at least one cycle of ice making and defrost operations in an incomplete condition. Although the serviceman returns usually after confirmed operation of the ice making machine, the attachment adhesive tape will be remained without removal from the ice detection switch if he confuses such one cycle of ice making and defrost operations with a normal operation of the ice making machine. This causes inconvenience to the user.

SUMMARY OF THE INVENTION

It is, therefore, a primary object of the present invention to provide an electric control apparatus for an ice making machine capable of preventing initial operation of the ice making machine in such an incomplete condition as described above.

According to the present invention, the object is accomplished by providing an electric control apparatus for an ice making machine mounted on an ice storage bin to store therein ice cubes formed at its ice making cycle and released at its defrost cycle, the ice storage bin having an ice detection switch of the normally open type arranged to issue an electric signal therefrom when closed by engagement with the ice cubes fully stored in the ice storage bin, which comprises means for maintaining the ice making machine inoperative when applied with the electric signal from the ice detection switch immediately after connected to an electric power source, means for activating the ice making machine after lapse of a predetermined time when the ice detection switch is opened in a condition where the ice making machine is maintained inoperative, and means for deactivating the ice making machine after lapse of a predetermined time when applied with the electric signal from the ice detection switch during operation of the ice making machine.

BRIEF DESCRIPTION OF THE DRAWINGS

Other objects, features and advantages of the present invention will be more readily appreciated from the following detailed description of a preferred embodiment thereof when taken together with the accompanying drawings, in which.

DESCRIPTION OF THE PREFERRED EMBODIMENT

Figure 1:
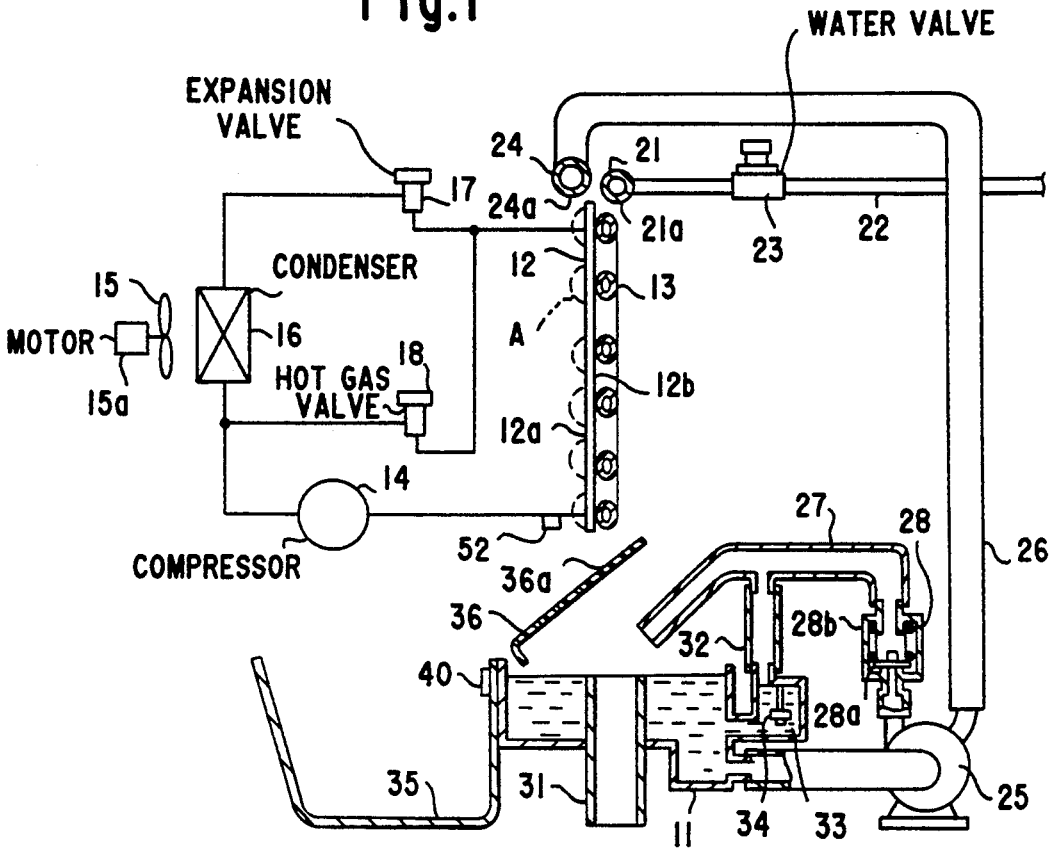
FIG. 1 is a schematic illustration of an ice making machine mounted on an ice storage bin.

Referring now to the drawings, FIG. 1 illustrates an ice making machine which is provided with a water tank 11 arranged to store an amount of ice making water and an upright ice making plate 12 of stainless sheet metal located above the water tank 11 to form ice cubes A on its front freezing surface 12*a*. An evaporator coil 13 is welded to a rear surface of ice making plate 12 and connected at its inlet to an expansion valve 17 and at its outlet to a refrigerant compressor 14. In a refrigeration circuit of the ice making machine, the compressor 14 is connected at its outlet to a finned condensor 16 provided with a cooling fan 15 driven by an electric motor 15*a*, and the condenser 16 is connected at its outlet to the expansion valve 17. The compressor 14 is further connected at its outlet to the downstream of expansion valve 17 by way of a bypass line provided with an electrically operated hot gas valve 18 of the normally closed type. Arranged above the rear surface 12*b* of ice making plate 12 is a watering pipe 21 which is connected to a water service pipe 22 through an electrically operated water valve 23 of the normally closed type. When supplied with fresh water from the water service pipe 22 through the water valve 23, the watering pipe 22 causes the supplied water to flow down from its sprinkler holes 21*a* along the rear surface 12*b* of ice making plate 12 as defrost water.

Arranged above the front freezing surface 12*a* of ice making plate 12 is a watering pipe 24 which is connected to a water pump 25 through a water supply pipe 26. When supplied with ice making water from the water supply pipe 26 in operation of the water pump 25, the watering pipe 24 causes the supplied ice making water to flow down from its sprinkler holes 24a along the front freezing surface 12a of ice making plate 12. The water pump 25 is driven by a reversible electric motor 25a to supply the ice making water into the water supply pipe 26 from the water tank 11 in its forward rotation and to supply the ice making water into a discharge pipe 27 from the water tank 11 in its reverse rotation. The discharge pipe 27 is provided with a pressure valve 28 which includes a valve body 28a loaded by a compression spring 28b downward to be normally closed. When applied with the water under pressure from the water pump 25, the valve body 28a is moved against the load of spring 28b to permit the flow of water into the discharge pipe 27. The outlet end of discharge pipe 27 is placed above an overflow pipe 31 disposed within the water tank 11 to discharge the ice making water through the overflow pipe 31.

Figure 2:
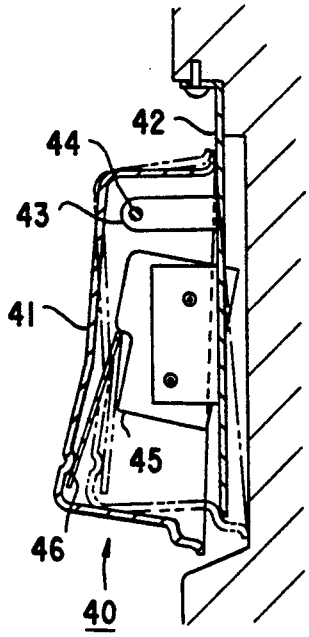
FIG. 2 is a sectional view of an ice detection switch mounted within an ice storage bin shown in FIG. 1.

The discharge pipe 27 is connected to a sub-tank 33 through a pipe 32 to render a portion of the supplied water flow into the sub-tank 33. The sub-tank 33 is communicated at its bottom portion with the water tank 11 and contains therein a float switch 34 of the normally open type which is arranged to be closed when the level of water in tank 11 becomes higher than a predetermined level and to be opened when the level of water in tank 11 becomes lower than the predetermined level. A perforated water plate 36 is arranged above the water tank 11 at an inclined angle to permit the water flowing down therethrough into the water tank 11 from the ice making plate 12 and to receive ice cubes released from the ice making plate 12. An ice storage bin 35 is arranged to store the ice cubes falling from the water plate 36, and an ice detection switch assembly 40 is mounted on an inside upper portion of the ice storage bin 35. As shown in FIG. 2, the ice detection switch assembly 40 includes a casing 41 tiltably assembled with a base plate 42 secured to the side wall of ice storage bin 35 by means of a bracket 43 and a support pin 42. When conditioned free from the ice cubes stored in the ice storage bin 35, the casing 41 is placed as shown by a solid line in the figure. When the ice storage bin 35 is filled with the ice cubes, the casing 41 is moved by engagement with the stored ice cubes as shown by an imaginary line in the figure.

Assembled within the casing 41 is an ice detection switch 45 which is fixed to the base plate 42. The ice detection switch 45 is in the form of a microswitch of the normally open type provided with a spring loaded lever 46 in engagement with an internal surface of casing 41. When the casing 41 is moved by engagement with the stored ice cubes as described above, the lever 46 is moved by load acting on the casing 41 as shown by the imaginary line in the figure to close the microswitch 45. When the ice making machine is transported to a user, the casing 41 is pressed toward the base plate 42 and retained in place by an adhesive tape attached thereto so that the ice detection switch 45 is retained in its closed position. When the ice making machine is installed with the ice storage bin 35 at the user's side, the attachment adhesive tape is usually removed by service personnel so that the ice detection switch 45 is returned to its open position.

Figure 3:
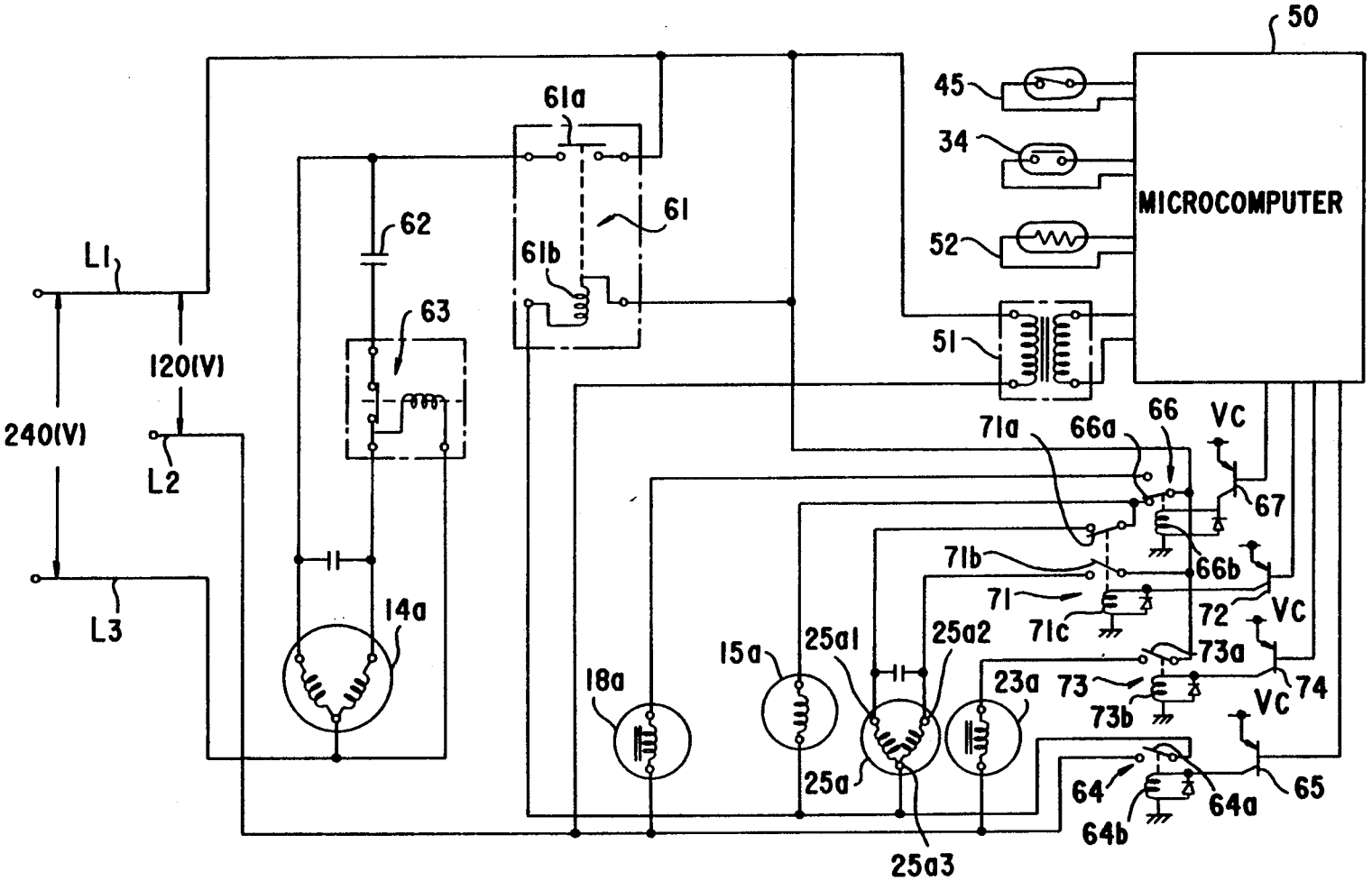
FIG. 3 is an electric control apparatus for the ice making machine in accordance with the present invention.

As shown in FIG. 3, an electric control apparatus for the ice making machine has three input buses $L_1$, $L_2$ and $L_3$ connected to an electric motor 14a of the refrigerant compressor 14, a solenoid 18a of hot gas valve 18, the electric motor 15a of cooling fan 15, the electric motor 25a of water pump 25, a solenoid 23a of water valve 23 and a control circuit 50 for the electric motors and solenoids. The input buses $L_1$, $L_2$, $L_3$ are connected to a commercially available power source of the single-phase three-wire type. In this embodiment, the input buses $L_1$, $L_2$ are arranged to be applied with a source voltage of 120 volt, while the input buses $L_1$, $L_3$ are arranged to be applied with a source voltage of 240 volt.

The electric motor 14a of compressor 14 is connected at its one end to the input bus $L_1$ through a normally open contact 61a of a relay switch 61 and at its other end to the input bus $L_3$. Interposed between the normally open contact 61a and the electric motor 14a are a drive capacitor 62 and a start relay 63. The normally open contact 61a is associated with a relay coil 61b which is connected at its one end to the input bus $L_1$ and at its other end to the input bus $L_2$ through a normally open contact 64a of a relay switch 64. When applied with the source voltage of 120 volt, the relay coil 61b is energized to close the normally open contact 61a. The normally open contact 64a of relay switch 64 is associated with a relay coil 64b which is grounded at its one and connected at its other end to the collector of a switching transistor 65. When applied with a DC voltage Vc in response to energization of transistor 65, the relay coil 64b is energized to close the normally open contact 64a.

The solenoid 18a of hot gas valve 18 and the motor 15a of cooling fan 15 are connected at their one ends to the input bus $L_1$ through a movable contact 66a of a relay switch 66. The solenoid 18a of hot gas valve 18 is connected at its other end to the input bus $L_2$, while the motor 15a of cooling fan 15 is connected at its other end to the input bus $L_2$ through the normally open contact 64a of relay switch 64. The movable contact 66a of relay switch 66 is retained in a first position during deenergization of the relay coil 66b to connect the electric motor 15a of cooling fan 15 to the input bus $L_1$ and is switched over from the first position to a second position in response to energization of the relay coil 66b to connect the solenoid 18a of hot gas valve 18 to the input bus $L_1$. The relay coil 66b is grounded at its one end and connected at its other end to the collector of a switching transistor 67 to be energized when the transistor 67 is turned on.

The electric motor 25a of water pump 25 has a first control terminal $25a_1$ for forward rotation connected to the input bus $L_1$ through a normally closed contact 71a of a relay switch 71 and the movable contact 66a of relay switch 66, a second control terminal $25a_2$ for reverse rotation connected to the input bus $L_1$ through a normally open contact 71b of relay switch 71, and a common terminal $25a_3$ connected to the input bus $L_2$ through the normally open contact 64a of relay switch 64. The relay switch 71 includes a relay coil 71c grounded at its one end and connected at its other end to the collector of a switching transistor 72. The normally closed contact 71a is opened in response to energization of the relay coil 71c, while the normally open contact 71b is closed in response to energization of the relay coil 71c. The solenoid 23a of water valve 23 is connected at its one end to the input bus $L_1$ through a normally open contact 73a of a relay switch 73 and at its other end to the input bus $L_2$. The relay switch 73 includes a relay coil 73b grounded at its one end and connected at its other end to the collector of a switching transistor 74. When the transistor 74 is turned on, the relay coil 73*b* is energized to close the normally open contact 73*a*.

Figure 4:
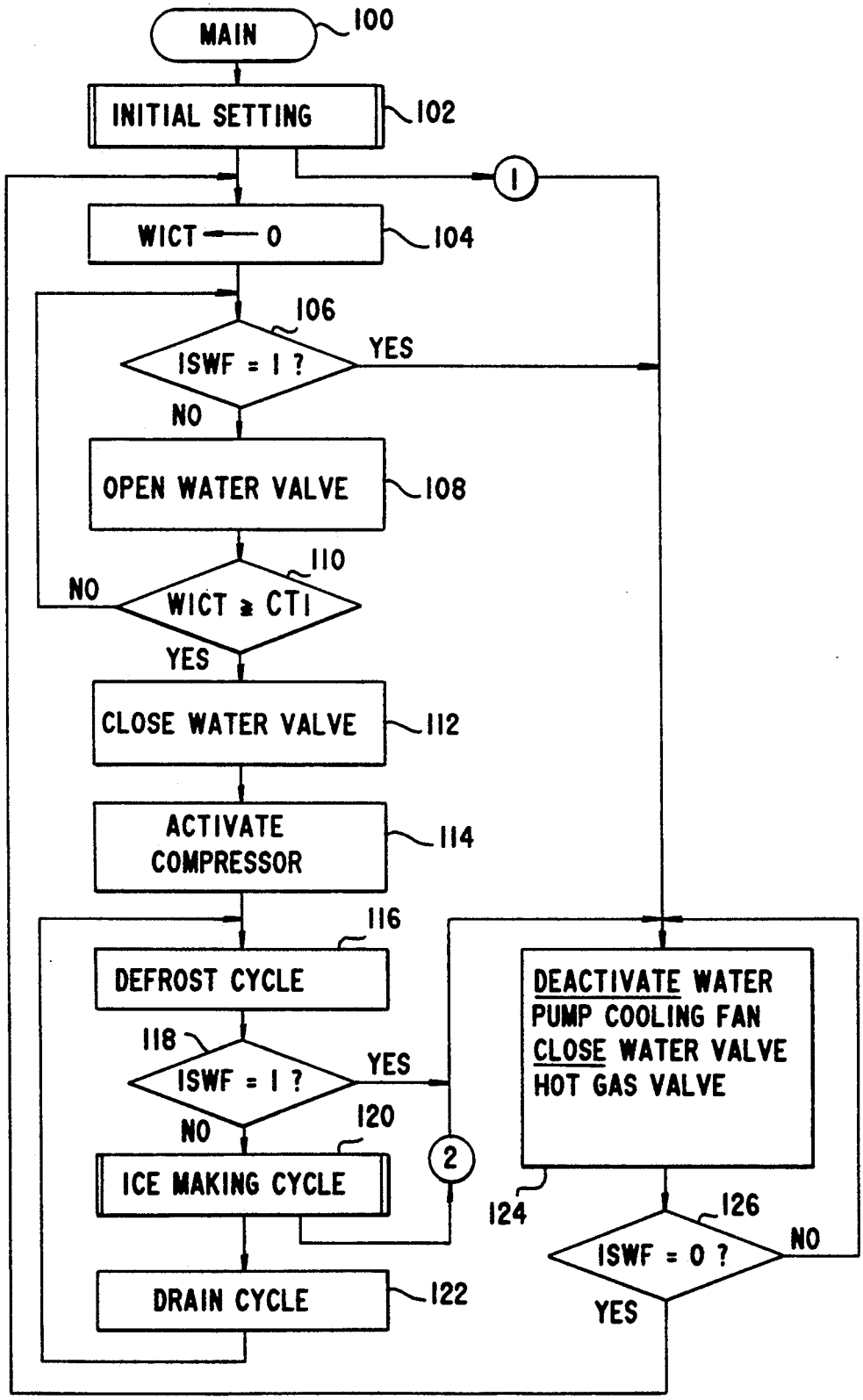
FIG. 4 is a flow chart of a main control program executed by a microcomputer shown in FIG. 3.
Figure 7:
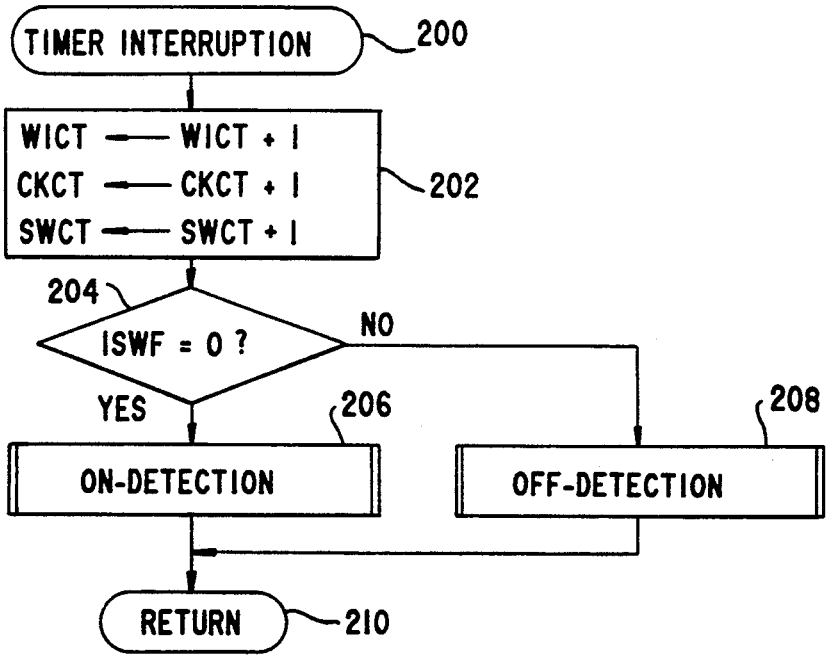
FIG. 7 is a flow chart of a timer interruption program executed by the microcomputer at a predetermined time interval.

The electric control circuit 50 is in the form of a microcomputer which is arranged to execute a main control program shown by a flow chart in FIG. 4 and to execute a timer interruption program shown by a flow chart in FIG. 7 for control of the switching transistors 65, 67, 72, 74 when applied with an interruption signal from a timer at a predetermined time interval. The computer has an input/output device or I/O connected to the switching transistors 65, 67, 72, 74 through an output gate (not shown) which is turned on in response to an output control signal from the computer to selectively apply the control signal to the switching transistors. The I/O of computer 50 is connected to a transformer 51 which is interposed between the input buses $L_1$ and $L_2$. The I/O of computer 50 is further connected to the float switch 34, the ice detection switch 45 and a thermal sensor 52. As shown in FIG. 1, the thermal sensor 52 is arranged at the outlet portion of evaporator coil 13 to produce an electric signal indicative of the temperature at the outlet portion of evaporator coil 13.

Figure 5:
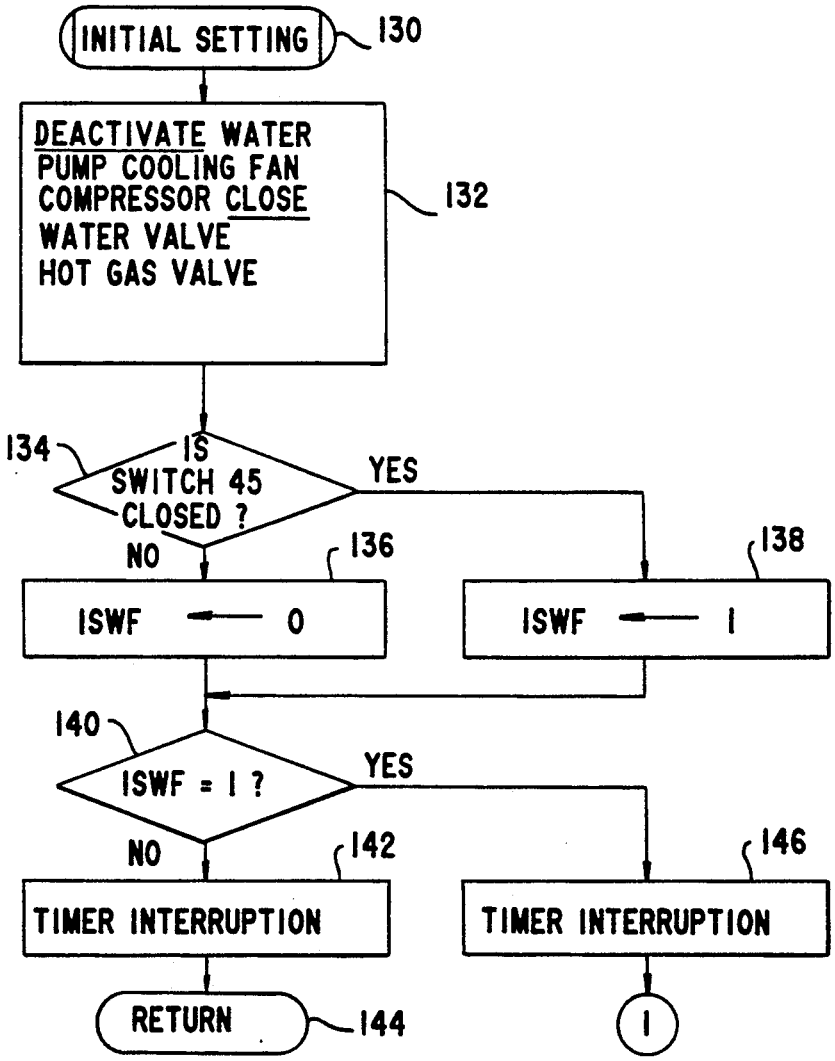
FIG. 5 is a flow chart of an initial setting routine of the main control program.

Hereinafter, the operation of the electric control apparatus will be described in detail. Assuming that a power source switch (not shown) has been closed to apply the power to the input buses $L_1$, $L_2$, $L_3$, the computer 50 is activated to initiate execution of the main control program at step 100 shown in FIG. 4 and executes at step 102 an initial setting routine shown in FIG. 5. Thus, the computer 50 initiates execution of the initial setting rountine at step 130 shown in FIG. 5 and deenergizes the switching transistors 65, 67, 72, 74 at step 132. Thus, the electric motors 14*a*, 15*a*, 25*a* and solenoids 18*a*, 23*a* are maintained in their deenergized conditions under control of the relay switches 61, 64, 66, 71 and 73 to deactivate the compressor 14, cooling fan 15 and water pump 25 and to close the hot gas valve 18 and water valve 23. As a result, the ice making mechanism is maintained in its deactivated condition. When the program proceeds to step 134, the computer 50 determines whether the ice detection switch 45 is closed or not. If the ice making machine is installed in a complete condition for use, the ice detection switch 45 is maintained in its open position. In such a situation, the computer 50 determines a "No" answer at step 134 and causes the program to proceed to step 136. Thus, the computer 50 sets an ice detection flag ISWF as "0" at step 136 and determines a "No" answer at step 140. Subsequently, the computer 50 permits execution of the timer interruption program at step 142 and finishes the execution of the initial setting routine at step 144. After execution of the initial setting routine, the computer 50 executes each control program for an initial water supply cycle, a defrost cycle, an ice making cycle and a drain cycle at step 104 to 122. As a result, a normal operation of the ice making machine is conducted, and the timer interruption program is executed by the computer 50 at the predetermined time interval as described later.

Assuming that the power source switch has been closed in a condition where the ice detection switch 45 is retained in its closed position without removing the attachment adhesive tape, the computer 50 determines a "Yes" answer at step 134 and causes the program to proceed to step 138. Thus, the computer 50 sets the ice detection flag ISWF as "1" at step 138 and determines a "Yes" answer at step 140. Subsequently, the computer 50 permits execution of the timer interruption program at step 146 and causes the program to proceed to step 124 shown in FIG. 4. In this instance, the computer 50 deenergizes all the switching transistors 65, 67, 72, 74 at step 124 and determines a "No" answer at step 126 until the ice detection flag ISWF becomes "0". This causes the computer 50 to repeat processing at step 124 and 126. When the ice detection switch 45 is opened by removal of the attachment adhesive tape during processing at step 124 and 126, the ice detection flag ISWF is set as "0" by processing at step 136 of the initial setting routine. Thus, the computer 50 determines a "Yes" answer at step 126 and returns the program to step 104. During processing at step 124 and 126, the timer interruption program is also executed at the predetermined time interval. Accordingly, even if the power source switch was closed in a condition where the ice making machine had been installed without removing the attachment adhesive tape, the ice making machine would not be operated.

During such execution of the main control program as described above, the computer 50 initiates execution of the timer interruption program at step 200 shown in FIG. 7. At step 202 of the interruption program, the computer 50 renews a water supply count value WICT, a check count value CKCT and a switch count value SWCT by addition of "1". During processing at the following step 204 to 208, the ice detection flag ISWF is set as "1" or "0" as will be described later.

Assuming that the attachment adhesive tape has been removed from the ice detection switch assembly 40 after installation of the ice making machine, the main control program proceeds to step 104 where the computer 50 sets the water supply count value WICT as "0". Subsequently, the computer 50 repeats processing at step 106 to 110 until the water supply count value WICT becomes a predetermined value $CT_1$ (for instance, a value indicative of one minute). During repetitive processing at step 106 to 110, the switching transistor 74 is turned on by processing at step 108 to energize the solenoid 23*a* of water valve 23. Thus, the water valve 23 is opened to permit the supply of fresh water into the watering pipe 21 from the water service pipe 22. In turn, the fresh water from watering pipe 21 falls along the rear surface 12*b* of ice making plate 12 and flows into the water tank 11. When the water supply count value WICT becomes the predetermined value $CT_1$ by execution of the timer interruption program, the computer 50 determines a "Yes" answer at step 110 and causes the program to step 112. At step 112, the computer 50 causes the switching transistor 74 to turn off for deenergizing the solenoid 23*a* of water valve 23. Thus, the water valve 23 is closed to finish an initial supply of fresh water to the water tank 11. If during processing at step 106 to 110 the ice detection flag ISWF becomes "1", the computer 50 causes the program to proceed to step 124 for stopping the operation of the ice making mechanism.

After processing at step 112, the computer 50 causes the switching transistor 65 at step 114 to turn on for energizing the relay coil 64*b*. Thus, the normally open contact 64*a* of relay switch 64 is closed in response to energization of the relay coil 64*b*, and in turn, the relay coil 61*b* is energized to close the normally open contact 61*a* of relay 61. As a result, the electric motor 14*a* is activated to start the refrigerant compressor 14 for circulating the refrigerant through the condenser 16, expansion valve 17 and evaporator 13 in the refrigerant circuit. Thereafter, the computer 50 executes a defrost cycle control routine, an ice making cycle control routine and a drain cycle control routine, respectively at step 116, 120 and 122.

When the program proceeds to step 116, the computer 50 causes the switching transistors 74 and 67 to turn on for energizing the relay coils 73*b* and 66*b*. Thus, the normally open contact 73*a* of relay switch 73 is closed in response to energization of the relay coil 73*b* to energize the solenoid 23*a* of water valve 23, and the movable contact 66*a* of relay switch 66 is switched over response to energization of the relay coil 66*b* to energize the solenoid 18*a* of hot gas valve 18. As a result, the water valve 23 is opened to supply fresh water into the watering pipe 21 from the water service pipe 22, while the hot gas valve 18 is opened to permit the supply of compressed hot gas into the evaporator 13 from the compressor 14. If in this instance, ice cubes are being formed on the front freezing surface 12*a* of ice making plate 12, the formed ice cubes are released from the ice making plate 12 and stored in the ice storage bin 35, while the newly supplied fresh water is stored in the water tank 11 to be used as ice making water. When the temperature at the outlet portion of evaporator 13 becomes equal to or higher than a predetermined temperature (for instance, 8° C.) during the defrost cycle, the computer 50 deenergizes the switching transistors 67, 74 after lapse of a predetermined time to deenergize the relay coils 66*b*, 73*b*. Thus, the movable contact 66*a* of relay switch 66 is switched over to deenergize the solenoid 18*a* of hot gas valve 18, and the normally open contact 73*a* of relay switch 73 is opened to deenergize the solenoid 23*a* of water valve 23. As a result, the hot gas valve 18 and water valve 23 are closed to finish the defrost cycle.

Figure 6:
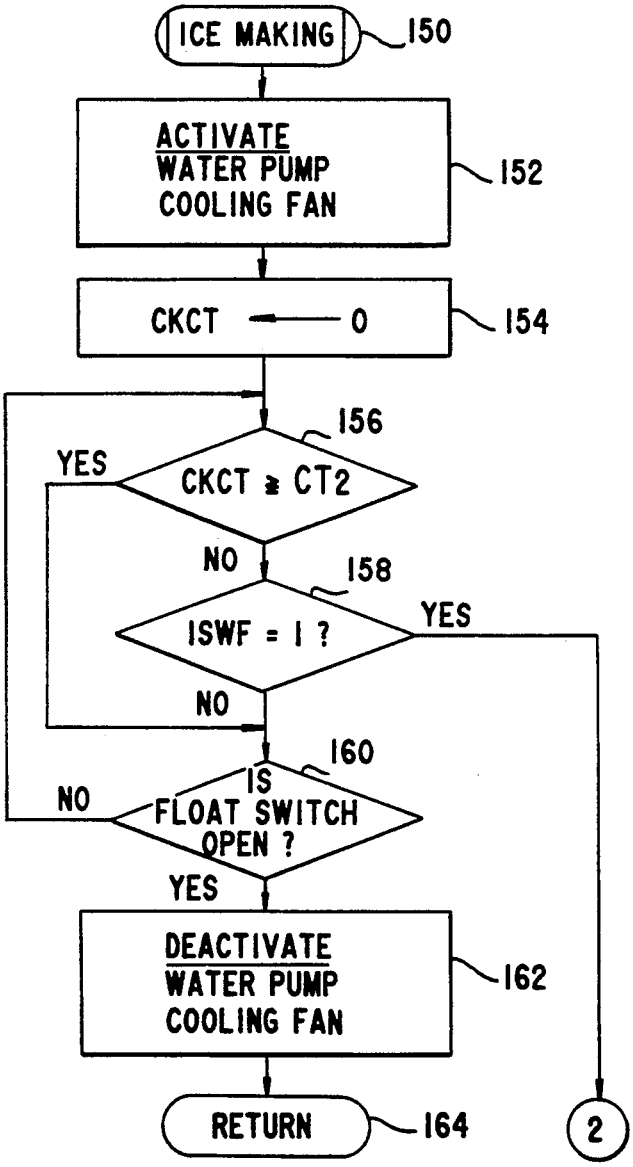
FIG. 6 is a flow chart of an ice making cycle control routine of the main control program.

After processing of the defrost cycle control routine, the computer 50 determines at step 118 whether the ice detection flag ISWF is "1" or not. If the answer at step 118 is "Yes", the computer 50 causes the program to proceed to step 124 for stopping the operation of the ice making mechanism. If the answer at step 118 is "No", the program proceeds to step 120 for execution of the ice making cycle control routine shown in FIG. 6. Thus, the computer 50 initiates execution of the ice making control routine at step 150 shown in FIG. 6 and causes the program to proceed to step 152 where the computer 50 deenergizes the switching transistors 67, 72. Subsequently, the computer 50 sets the check count value CKCT as "0" at step 154 and repeats processing at step 156 to 160 until the float switch 34 is opened. Since the switching transistors 67, 72 are turned off upon finish of the defrost cycle, the computer 50 acts to maintain the switching transistors 67, 72 non-conductive. During processing at step 156 to 160, the electric motors 15*a* and 25*a* are activated under control of the relay switches 66, 71 to rotate the cooling fan 15 and to rotate the water pump 25 in a forward direction. Thus, the watering pipe 24 is supplied with the ice making water from the water tank 11 through the water supply pipe 26 under forward rotation of the pump 25 and causes the supplied water to flow down along the front freezing surface 12*a* of ice making plate 12. In this instance, the hot gas valve 18 is closed under control of the relay switch 66, and the electric motor 14*a* of compressor is activated under control of the relay switch 64.

Under such control of the computer 50, the evaporator 13 is supplied with expanded refrigerant from the expansion valve 17 under operation of the compressor 14 to freeze the water flowing down along the front surface 12 of ice making plate 12. When the water flowing down along the front surface 12*a* of ice making plate 12 is progressively frozen by the evaporator 13 into ice cubes A, the level of water in tank 11 will gradually lower to the predetermined level at which the float switch 34 is opened. When the float switch 34 is opened, the computer 50 determines a "Yes" answer at step 160 and causes the program to proceed to step 162. Thus, the computer 50 energizes the switching transistor 67 at step 162 and finishes execution of the ice making cycle control routine at step 164. As a result, the electric motors 15*a* and 25*a* are deactivated under control of the relay switch 66 to finish the ice making cycle.

During such processing at step 156 to 160 as described above, the computer 50 determines at step 156 whether the check count value CKCT is equal to or larger than a predetermined value $CT_2$ (for instance, a value indicative of five minutes) and determines at step 158 whether the ice detection flag ISWF is "1" or not. Since the check count value CKCT is initially set as "0" at step 154 to be increased by addition of "1" at each execution of the interruption program, the processing at step 158 is executed for about five minutes after start of the ice making cycle. If the ice detection flag ISWF is set as "1" within five minutes, the computer 50 determines a "Yes" answer at step 158 and causes the program to proceed to step 124 for stopping the operation of the ice making mechanism.

After execution of the ice making cycle control routine, the main control program proceeds to step 122 where the computer 50 executes the drain cycle control routine. During execution of the drain cycle control routine, the computer 50 energizes the switching transistor 72 for about twenty seconds. Since the switching transistor 67 is previously energized at the end of the ice making cycle, the electric motor 25*a* is activated under control of the relay switches 66, 71 to rotate the water pump 25 in a reverse direction for about twenty seconds. Thus, the ice making water is supplied into the discharge pipe 27 from the water tank 11, and the pressure valve 28 is opened to permit the ice making water discharged therethrough from the water tank 11 into the overflow pipe 31. In this instance, a portion of the ice making water is supplied into the sub-tank 33 through pipe 32 for washing the float switch 34. After execution of the drain cycle control routine, the computer 50 returns the program to step 116 to successively execute the defrost cycle control routine, the ice making cycle control routine and the drain cycle control routine as described above. As a result, ice cubes formed at the ice making cycle are released at the defrost cycle and stored in the ice storage bin 35.

Figure 8:
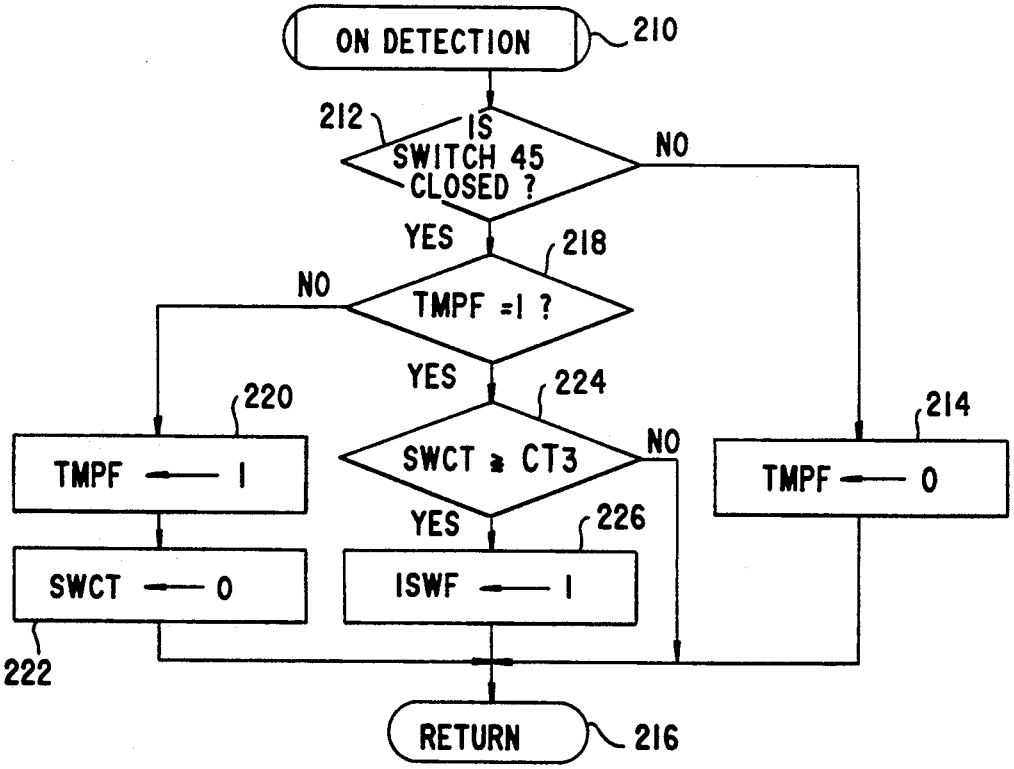
FIG. 8 is a flow chart of an ON-detection routine of the interruption program.

Assuming that the ice detection switch 45 is retained in its open position during accumulation of the ice cubes in storage bin 35, the ice detection flag ISWF is maintained as "0". In such a situation, the computer 50 determines a "Yes" answer at step 204 of the timer interruption program and causes the program to proceed to step 206 for an ON-detection routine shown in FIG. 8. Thus, the computer 50 initiates execution of the ON-detection routine at step 210 shown in FIG. 8. If the ice detection switch 45 is still maintained in its open position, the computer 50 determines a "No" answer at step 212, sets a temporary flag TMPF as "0" at step 214 and finishes execution of the ON-detection routine at step 216.

When the ice detection switch 45 is closed by increase of the stored ice cubes in storage bin 35, the computer 50 determines a "Yes" answer at step 212 of the ON-detection routine and causes the program to proceed to step 218. In this instance, the computer 50 determines a "No" answer at step 218, sets the temporary flag TMPF as "1" at step 220 and sets the switch count value SWCT as "0" at step 222. If the ice detection switch 45 is subsequently maintained in its closed position, the computer 50 determines a "Yes" answer at step 218 and determines a "No" answer at step 224 to maintain the ice detection flag ISWF as "0" until the switch count value SWCT becomes equal to or larger than a predetermined value $CT_3$ (for instance, a value indicative fifteen minutes). Upon lapse of the predetermined time defined by value $CT_3$, the computer 50 determines a "Yes" answer at step 224 and causes the program to proceed to step 226 where the ice detection flag ISWF is set as "1". If the ice detection switch 45 is opened before lapse of the predetermined time defined by value $CT_3$, the computer 50 determines a "No" answer at step 212 and sets the temporary flag TMPF as "0". Accordingly, the ice detection flag ISWF is set as "1" only when the ice detection switch 45 is maintained in its closed position for the predetermined time. Thus, the ice detection flag ISWF may not be set as "1" even if the ice detection switch 45 is temporarily closed by abutment with the ice cubes falling into the storage bin 35 from the water plate 36.

When the ice detection flag ISWF is set as "1" within five minutes during the initial water supply cycle, after the defrost cycle or during the ice making cycle, the computer 50 determines a "Yes" answer at step 106, 118 or 158 and causes the program to proceed to step 124 for stopping the operation of the ice making mechanism. With such control of the ice making mechanism, an overflow of ice cubes from the storage bin 35 can be avoided in the case that a plurality of ice making mechanisms (not shown) are mounted on the storage bin 35.

Figure 9:
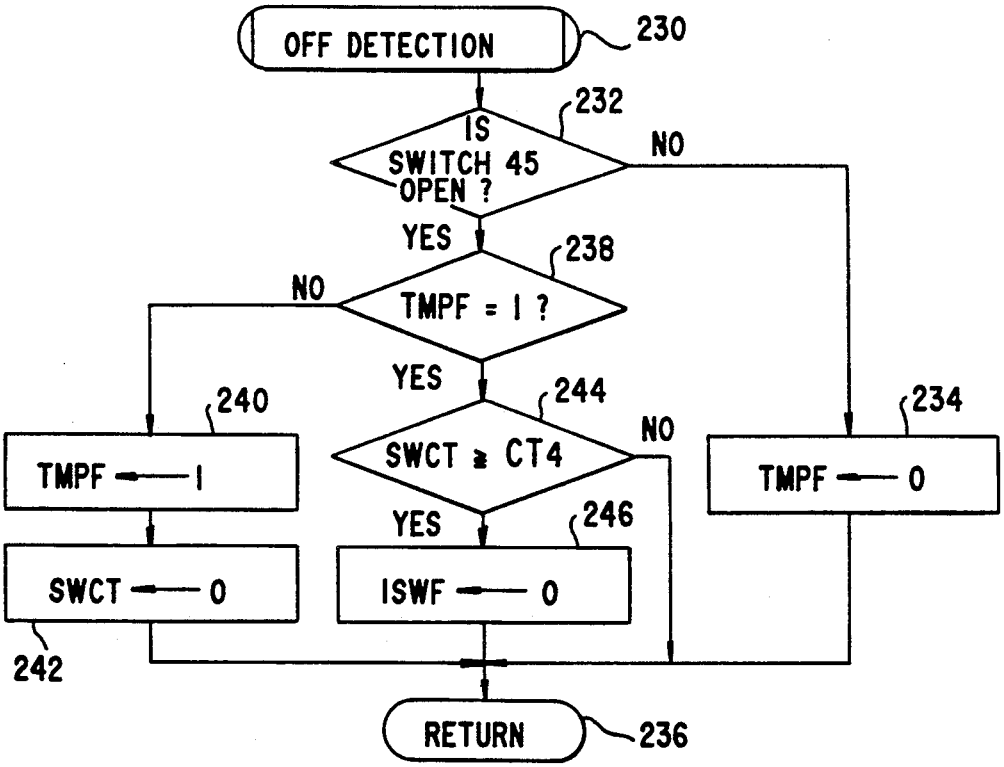
FIG. 9 is a flow chart of an OFF-detection routine of the interruption program.

When the timer interruption program is executed in a condition where the ice making mechanism is stopping due to ice cubes filled in the storage bin 35, the computer 50 determines a "No" answer at step 204 shown in FIG. 7 and causes the program to proceed to step 208 for an OFF-detection routine shown in FIG. 9. Thus, the computer 50 initiates execution of the OFF-detection routine at step 230 shown in FIG. 9 and determines a "No" answer at step 232 if the ice detection switch 45 is still maintained in its closed position. In this instance, the computer 50 sets the temporary flag TMPF as "0" at step 234 and finishes execution of the OFF-detection routine at step 236. When the stored ice cubes in storage bin 35 are taken out for use, the ice detection switch 45 is opened by return movement of the spring loaded lever 46. In this instance, the computer 50 determines a "Yes" answer at step 232 of the OFF-detection routine and causes the program to proceed to step 238. Thus, the computer 50 determines a "No" answer at step 238, sets the temporary flag TMPF as "1" at step 240 and sets the switch count value SWCT as "0" at step 242. If the ice detection switch 45 is subsequently maintained in its open position, the computer 50 determines a "Yes" answer at step 238 and determines a "No" answer at step 244 to maintain the ice detection flag ISWF as "1" until the switch count value SWCT becomes equal to or larger than a predetermined value $CT_4$ (for instance, a value indicative of about one minute). Upon lapse of the predetermined time defined by value $CT_4$, the computer 50 determines a "Yes" answer at step 244 and causes the program to proceed to step 246 where the ice detection flag ISWF is set as "0". Thus, if the ice detection switch 45 is temporarily opened by takeout of the ice cubes from the storage bin 35, the ice detection flag ISWF may not be set as "0".

When the ice detection flag ISWF is set as "0" during stopping of the ice making mechanism, the computer 50 determines a "Yes" answer at step 126 during repetitive processing at step 124 and 126 and returns the program to step 104 for execution of the water supply control routine, the defrost cycle control routine, the ice making cycle control routine and the drain cycle control routine at step 106 to 122.

In a practical embodiment of the present invention, the ice detection flag ISWF may be adapted to turn on an indication lamp for informing the user of the operating condition of the ice making machine.

What is claimed is:

1. An electric control apparatus for an ice making machine mounted on an ice storage bin to store therein ice cubes formed at its ice making cycle of operation and released at its defrost cycle of operation, the ice storage bin having an ice detection switch of the normally open type arranged to issue an electric signal therefrom when closed by engagement with the ice cubes fully stored in the ice storage bin, comprising:

means for maintaining the ice making machine inoperative when applied with the electric signal from said ice detection switch immediately after being connected to an electric power source;

means for activating the ice making machine after lapse of a predetermined time when said ice detection switch is opened in a condition where the ice making machine is maintained inoperative; and means for deactivating the ice making machine after lapse of a predetermined time when applied with the electric signal from said ice detection switch during operation of the ice making machine.

2. An electric control apparatus as recited in claim 1, wherein said ice detection switch is an electromechanical switch.

* * * * *